US011408245B2

(12) United States Patent
Dudzinski et al.

(10) Patent No.: US 11,408,245 B2
(45) Date of Patent: Aug. 9, 2022

(54) DISSOLVABLE BRIDGE PLUG ASSEMBLY

(71) Applicant: Parker-Hannifin Corporation, Cleveland, OH (US)

(72) Inventors: Paul Dudzinski, Meriden, CT (US); Daniel J. Funke, San Diego, CA (US); Kenneth W. Cornett, Ivoryton, CT (US)

(73) Assignee: Parker-Hannifin Corporation, Cleveland, OH (US)

( * ) Notice: Subject to any disclaimer, the term of this patent is extended or adjusted under 35 U.S.C. 154(b) by 464 days.

(21) Appl. No.: 15/737,128

(22) PCT Filed: Aug. 22, 2016

(86) PCT No.: PCT/US2016/047974

§ 371 (c)(1),
(2) Date: Dec. 15, 2017

(87) PCT Pub. No.: WO2017/044298

PCT Pub. Date: Mar. 16, 2017

(65) Prior Publication Data

US 2018/0171746 A1 Jun. 21, 2018

Related U.S. Application Data

(60) Provisional application No. 62/215,209, filed on Sep. 8, 2015.

(51) Int. Cl.

| | |
|---|---|
| ***E21B 33/129*** | (2006.01) |
| ***E21B 33/134*** | (2006.01) |
| ***E21B 33/128*** | (2006.01) |

(52) U.S. Cl.

CPC ..... *E21B 33/128* (2013.01); *E21B 33/1293* (2013.01); *E21B 33/134* (2013.01); *E21B 2200/08* (2020.05)

(58) Field of Classification Search

CPC ..... E21B 33/1285; E21B 33/1208; E21B 33/1293; E21B 33/134

See application file for complete search history.

(56) References Cited

U.S. PATENT DOCUMENTS 3,074,484 A * 1/1963 Conrad ..... E21B 33/1291 166/216
3,181,614 A * 5/1965 Brown ..... E21B 33/1295 166/122

(Continued)

FOREIGN PATENT DOCUMENTS

| | | |
|---|---|---|
| CA | 2916373 | 12/2014 |
| CN | 204476347 | 7/2015 |
| WO | WO 2012158261 | 11/2012 |

OTHER PUBLICATIONS

International Search Report of PCT/US2016/047974 dated Oct. 27, 2016, 3 pages.

*Primary Examiner* — Robert E Fuller

(74) *Attorney, Agent, or Firm* — Renner, Otto, Boisselle & Sklar, LLP

(57) ABSTRACT

A bridge plug assembly includes a tee bushing including a base and a stem, a coned bushing having a conical section and defining a bore that is configured to receive the stem, a molded assembly that is moveable over the conical section from an initial position to a set position, and a seal. The conical section is configured as a wedge such that when the stem is forced into the conical section during a setting process, the molded assembly and the seal move over the conical section from the initial position to the set position and expand radially outward by a wedge action of the conical section against a well casing. The molded assembly includes a slip assembly having a plurality of slip segments, over-molded with an elastomer. All components are made of (Continued)

dissolvable materials so as to reopen the well casing over time to its original inner diameter.

16 Claims, 6 Drawing Sheets

(56) References Cited

U.S. PATENT DOCUMENTS 3,385,679 A * 5/1968 Current ..... E21B 33/1293 428/579
RE31,978 E * 9/1985 McStravick ..... E21B 33/1208 166/124
5,862,861 A * 1/1999 Kalsi ..... E21B 33/12 166/192
6,302,217 B1 * 10/2001 Kilgore ..... E21B 33/1295 166/382
6,467,540 B1 * 10/2002 Weinig ..... E21B 33/1293 166/120
8,839,855 B1 * 9/2014 McClinton ..... E21B 33/1292 166/135
10,400,535 B1 * 9/2019 Greenlee ..... E21B 33/1292
2010/0133864 A1 6/2010 Syse
2011/0024134 A1 * 2/2011 Buckner ..... E21B 33/1204 166/382
2013/0292123 A1 * 11/2013 Murphree ..... E21B 34/14 166/308.1
2014/0060812 A1 * 3/2014 Young ..... E21B 33/134 166/118
2014/0090831 A1 * 4/2014 Young ..... E21B 33/1291 166/118
2014/0196889 A1 7/2014 Oberg et al.
2015/0053428 A1 * 2/2015 Xu ..... E21B 33/128 166/386
2016/0061000 A1 * 3/2016 Rochen ..... B29C 45/14 166/138
2016/0097255 A1 * 4/2016 Doane ..... E21B 33/128 166/308.1
2016/0108165 A1 4/2016 Takahashi et al.
2016/0281458 A1 * 9/2016 Greenlee ..... E21B 23/06
2016/0298407 A1 * 10/2016 Takahashi ..... E21B 29/02
2016/0312555 A1 * 10/2016 Xu ..... E21B 43/26
2017/0198545 A1 * 7/2017 Jurgensmeier ..... E21B 34/10
2017/0260823 A1 * 9/2017 Roseman ..... E21B 33/128
2018/0016864 A1 * 1/2018 Parekh ..... E21B 43/26
2018/0038193 A1 * 2/2018 Walton ..... E21B 33/134
2018/0216431 A1 * 8/2018 Walton, III ..... E21B 33/128

* cited by examiner

DISSOLVABLE BRIDGE PLUG ASSEMBLY

RELATED APPLICATIONS

This application is national stage application pursuant to 35 U.S.C. § 371 of PCT/US2016/047974 filed on Aug. 22, 2016, which claims the benefit of U.S. Provisional Application No. 62/215,209 filed Sep. 8, 2015, the contents of which are incorporated herein by reference.

FIELD OF INVENTION

The present invention relates to down hole plug seals to isolate zones during drilling operations and other well service, and particularly dissolvable bridge plug assembly type down hole plug seals.

BACKGROUND OF THE INVENTION

In oil and gas drilling operations, a variety of down hole tools are used for the manufacturing, operation, and maintenance of such drilling systems. One example of a down hole tool is a plug seal, which can be used to seal and isolate certain portions of a drilled well from other portions of the well. A sealing plug that fully isolates one well portion (e.g., a down hole portion) from another well portion (e.g., an up hole portion), wholly blocking flow between the two portions, is commonly referred to as a bridge plug. Other types of plug seals may allow flow in a particular direction (e.g., downstream), but block flow in other directions (e.g., upstream). Plug seals may be permanent, or may be non-permanent dissolving or otherwise removable plug seals.

Hydraulic fracturing (commonly referred to as "fraccing" or "fracking") is becoming a common method of oil and gas well stimulation, which may employ bridge plugs to operate different portions of a well. For example, a bridge plug may be located within an outer well casing so as to isolate a down hole portion of a well from an up hole portion of the well. In the up hole portion, the well casing may include a plurality of transverse holes that open into a surrounding rock formation. In the hydraulic fracturing process, pressurized fluid is pumped down into the well. At the bridge plug, flow is blocked from proceeding from the up hole portion into the down hole portion, pressurizing the well. Under such pressure, the fluid is forced through the holes in the up hole well casing into the adjacent rock formation. The pressurized flow into the rock formation in turn creates cracks through which oil and gas may be extracted.

Conventional dissolvable bridge plugs, however, have proven to be deficient in certain respects. There is significant interest in reducing the costs associated with well treatment, and dissolvable bridge plugs have been employed so that well casings may open without the need to be milled out to allow flow, which can be expensive. Conventional dissolvable bridge plugs, however, typically result in a diameter significantly smaller than the original casing inner diameter. In addition, dissolvable materials tend to be weaker than non-dissolvable materials, which renders it more difficult to provide an effective dissolvable bridge plug resulting in relatively large and material intensive assemblies, which increases costs.

SUMMARY OF THE INVENTION

The present invention provides an enhanced dissolvable bridge plug assembly that overcomes deficiencies of conventional configurations. The dissolvable bridge plug assembly of the present invention temporarily isolates sections of the well casing with high effectiveness, and then fully dissolves to regain essentially the full casing inner diameter without any further milling or comparable intervention. In addition, the dissolvable bridge plug assembly of the present invention provides effective sealing within the well casing with reduced component size and/or reduced material amounts, and therefore with less cost, as compared to conventional configurations.

The bridge plug assembly includes a tee bushing that is received within a coned bushing. The bridge plug assembly further includes a molded assembly including a slip assembly that is over-molded with an elastomer, and an additional seal. The molded assembly initially is positioned to partially circumscribe the stem portion of the tee bushing and extend over a conical section of the coned bushing. During the setting process, a setting tool joins the tee bushing and the coned bushing. This forces the molded assembly and the seal to move over the conical section of the coned bushing, and a wedge action of the conical section results in expansion of the molded assembly and the seal. Ultimately, the expansion results in the slip assembly biting into or otherwise gripping an inner diameter of the well casing, with the elastomer filling in gaps between segments of the slip assembly having thus expanded. Similarly, the seal expands and is compressed to provide a seal against the well casing. The components of the bridge plug assembly are made of dissolvable materials, and over time, the bridge plug assembly dissolves so as to open the well casing essentially to its original diameter.

An aspect of the invention, therefore, is a bridge plug assembly. In exemplary embodiments, the bridge plug assembly includes a tee bushing including a base and a stem that extends from the base, a coned bushing having a conical section and defining a bore that is configured to receive the stem of the tee bushing, an expandable molded assembly that is moveable over the conical section from an initial position to a set position, and a seal located adjacent to the molded assembly. In the initial position the molded assembly at least partially circumscribes the stem and the conical section. The conical section is configured as a wedge such that when the stem of the tee bushing is forced into the conical section of the coned bushing during a setting process, the molded assembly and the seal move over the conical section from the initial position to the set position and expand radially outward by a wedge action of the conical section. All components of the bridge plug assembly are made of dissolvable materials so as to reopen the well casing over time to its original inner diameter.

The molded assembly may include a slip assembly over-molded with an elastomer. The slip assembly may include a plurality of slip segments configured as a polar array, and when the molded assembly expands moving from the initial position to the set position, the elastomer fills gaps formed between the slip segments. An outer surface of each of the slip segments bites into or otherwise grips an inner surface of the well casing to lock the bridge plug assembly in place.

Another aspect of the invention is a setting process for a bridge plug assembly. In exemplary embodiments, the setting process includes the steps of providing the bridge plug assembly; connecting the bridge plug assembly to a setting tool and locating the bridge plug assembly at a desired position within a well casing; and actuating the setting tool to join the tee bushing and the coned bushing by forcing the stem of the tee bushing into the conical section of the coned bushing. The conical section is configured as a wedge such that when the stem of the tee bushing is forced into the conical section of the coned bushing by actuating the setting tool, the molded assembly and the seal move over the conical section from the initial position to the set position and expand radially outward to the well casing by a wedge action of the conical section, thereby isolating an up hole portion of the well casing from a down hole portion of the well casing.

These and further features of the present invention will be apparent with reference to the following description and attached drawings. In the description and drawings, particular embodiments of the invention have been disclosed in detail as being indicative of some of the ways in which the principles of the invention may be employed, but it is understood that the invention is not limited correspondingly in scope. Rather, the invention includes all changes, modifications and equivalents coming within the spirit and terms of the claims appended hereto. Features that are described and/or illustrated with respect to one embodiment may be used in the same way or in a similar way in one or more other embodiments and/or in combination with or instead of the features of the other embodiments.

DETAILED DESCRIPTION

Figure 1:
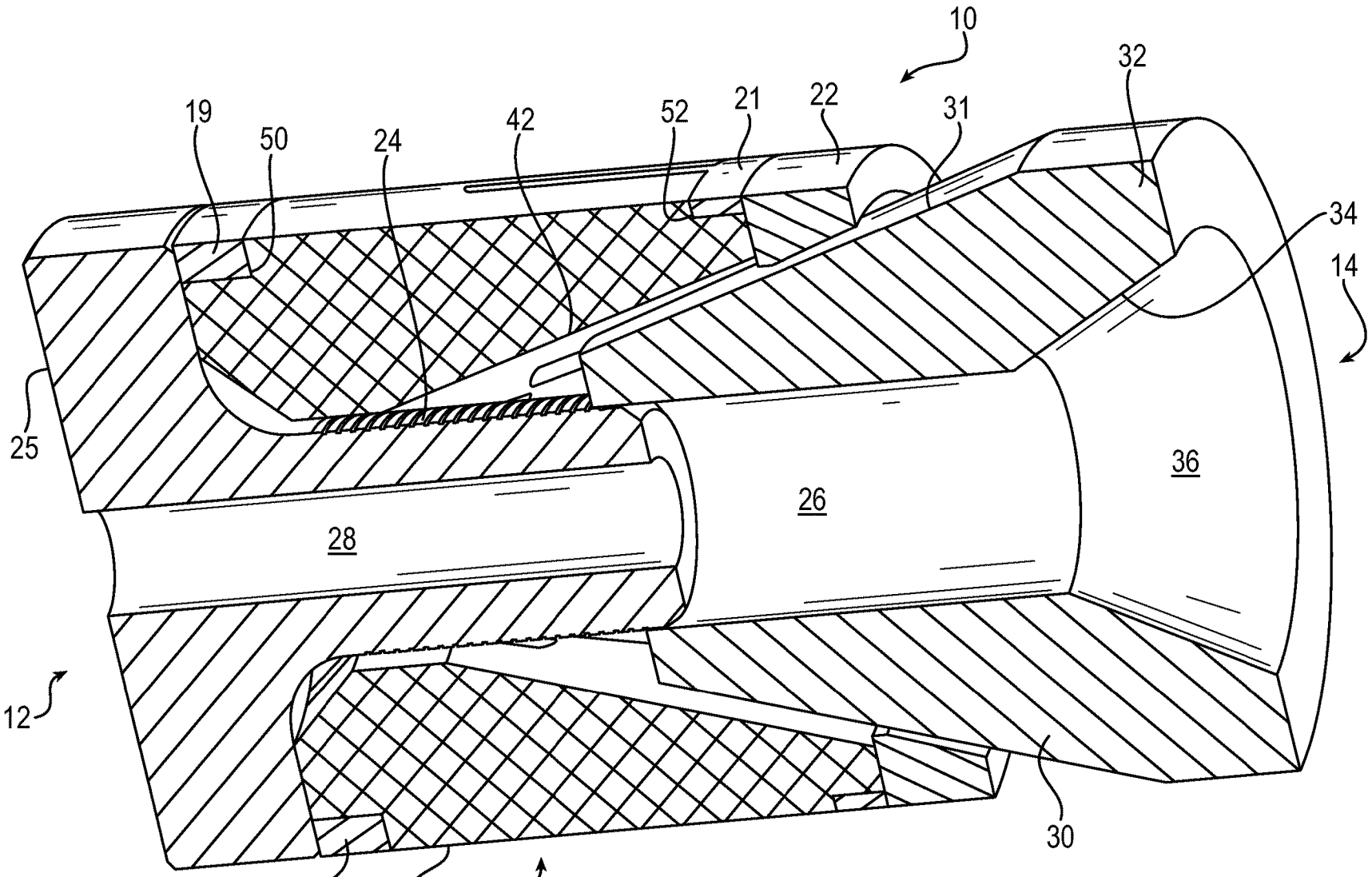
FIG. 1 is a drawing depicting an isometric cross-sectional view of an exemplary dissolvable bridge plug assembly in accordance with embodiments of the present invention.

Embodiments of the present invention will now be described with reference to the drawings, wherein like reference numerals are used to refer to like elements throughout. It will be understood that the figures are not necessarily to scale.

Figure 2:
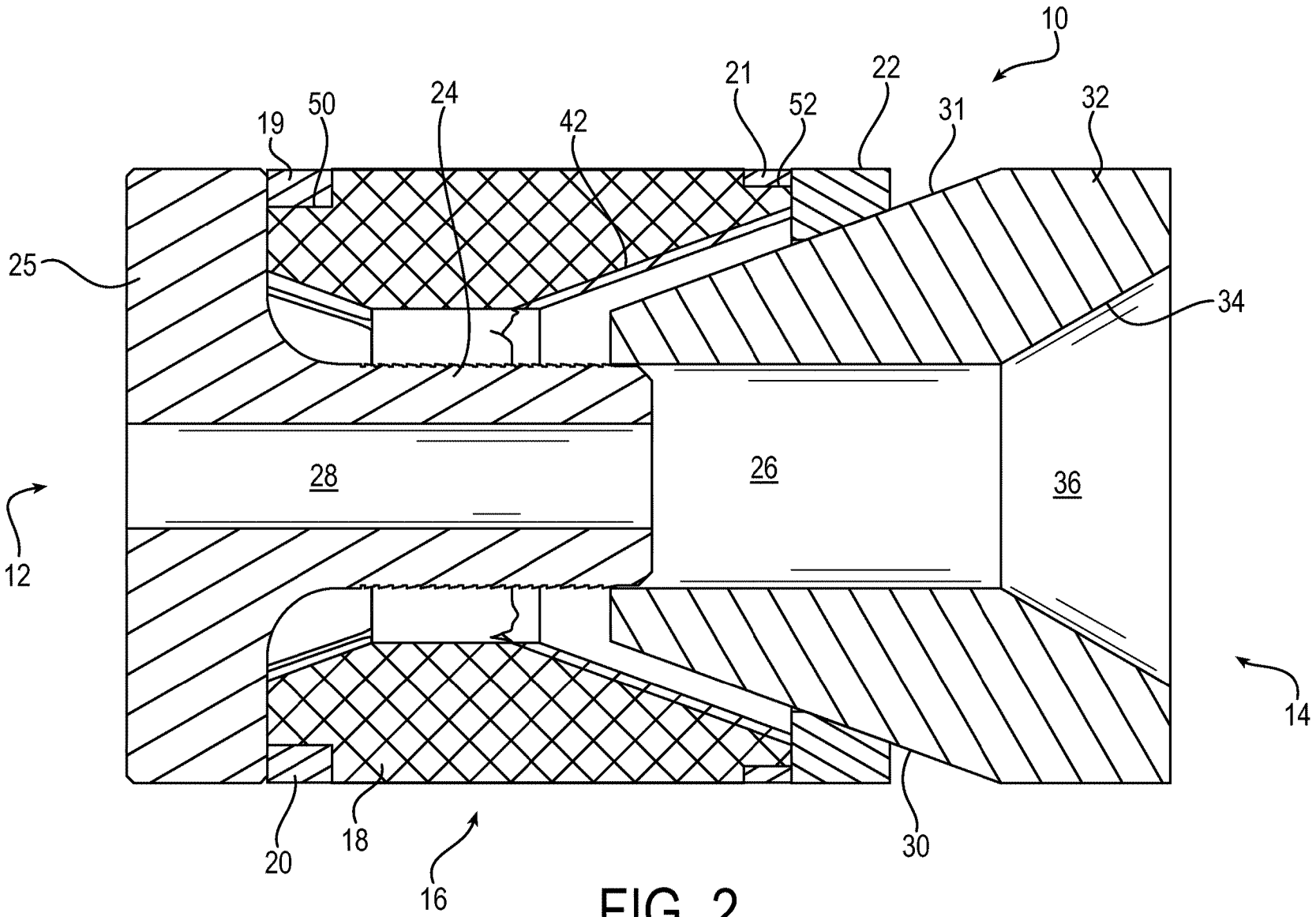
FIG. 2 is a drawing depicting a side cross-sectional view of the exemplary dissolvable bridge plug assembly of FIG. 1.

FIG. 1 is a drawing depicting an isometric cross-sectional view of an exemplary dissolvable bridge plug assembly 10 in accordance with embodiments of the present invention. FIG. 2 is a drawing depicting a side cross-sectional view of the exemplary dissolvable bridge plug assembly 10 of FIG. 1.

The components of the bridge plugs assembly 10 are made of dissolvable materials to provide a temporary bridge plug that dissolves over a period of time to re-open a drilling segment without the need for any additional intervention. The fully dissolvable bridge plug assembly results in the well casing of the isolated segment re-opening essentially to its original diameter. As further detailed below, portions of the bridge plug assembly 10 are made from dissolvable rigid materials, and particularly dissolvable metal alloys. Examples of such materials include degradable aluminum alloys, degradable magnesium alloys, degradable rigid polymers like polyglycolic acid (PGA), and similar materials. Other components may perform a sealing function or otherwise are elastomeric, and thus are made of dissolvable elastomeric materials, including for example a dissolving elastomer such as such as PGCL/HDI described in published patent application US 2012/0142884, or comparable material. As referenced above, during use, the bridge plug assembly 10 dissolves such that the casing bore can eventually open back up essentially to its full bore inner diameter.

Generally, in exemplary embodiments, the bridge plug assembly includes a tee bushing including a base and a stem that extends from the base, a coned bushing having a conical section and defining a bore that is configured to receive the stem of the tee bushing, an expandable molded assembly that is moveable over the conical section from an initial position to a set position, and a seal located adjacent to the molded assembly. In the initial position the molded assembly at least partially circumscribes the stem and the conical section. The conical section is configured as a wedge such that when the stem of the tee bushing is forced into the conical section of the coned bushing during a setting process, the molded assembly and the seal move over the conical section from the initial position to the set position and expand radially outward by a wedge action of the conical section. All components of the bridge plug assembly are made of dissolvable materials so as to reopen the well casing over time essentially to its original inner diameter.

As seen in FIGS. 1 and 2, the bridge plugs assembly 10 may be configured as a stacked assembly that includes the following principal components: a tee bushing 12; a coned bushing 14; a molded assembly component 16 including a slip assembly 18 over-molded with an elastomer 20; and a seal 22.

In exemplary embodiments, the tee bushing 12 is a rigid component that may be made from a dissolving metal alloy or PGA as referenced above, and of sufficient thickness to support the loads that are imposed during the setting or activation process. The tee bushing 12 has a stem 24 that extends from a base 25, and the stem 24 is inserted into a bore 26 that is defined by the coned bushing 14. The interaction of the tee bushing 12 with the coned bushing 14 in this manner aids in keeping the components of the bridge plug assembly aligned, and further provides for an interference fit between the tee bushing and coned bushing. This interference fit is configured or operative to keep the components of the bridge plug assembly joined together and in a locked in position within the casing bore during use. There is a through-hole 28 within the tee bushing 12, which is configured to receive and couple to a setting tool, such as a setting tool's draw rod (not shown). The tee bushing and draw rod can be attached to each other by any suitable means, such as by a thread in the tee bushing through-hole 28, by using shear pins, or other suitable structures.

In exemplary embodiments, the coned bushing 14 similarly is a rigid element that may be made of a dissolving metal alloy or PGA as referenced above. As also referenced above, the coned bushing may define the bore 26 that receives the stem 24 of the tee bushing 12. The coned bushing 14 includes a conical section 30 that specifically defines the bore 26. An outer surface 31 of the of the conical section 30 is sloped outward from a down hole end toward an up hole end of the coned bushing to form a wedge configuration. As further detailed below, the conical section is configured as such a wedge so that when the stem of the tee bushing is forced into the conical section of the coned bushing during a setting process, the molded assembly and the seal move over the conical section from the initial position to the set position, and expand radially outward by a wedge action of the conical section.

The coned bushing further has an end section 32 that is up hole relative to the conical section 30, and the end section 32 is contiguous with the conical section 30. The end section 32 has a sloped inner diameter 34 that is configured as a seat surface that defines a seat space 36. The seat surface of the inner diameter 34 is configured to receive a ball sealer (not shown) that is located on the seat surface 34 and seals the well segment against flow through the bridge plug assembly during use until the bridge plug assembly dissolves away. The bore 26 is configured to couple with the stem 24 of the tee bushing 12 to lock such components together with an interference fit as referenced above.

In exemplary embodiments, the seal 22 may be molded from a dissolving elastomeric material. In exemplary embodiments as shown in FIGS. 1 and 2, the seal 22 may be a discrete component provided as a separate component adjacent to the molded assembly component 16. Alternatively, the seal may be configured as part of the elastomer 20 as an integral component of the molded assembly component 16. As seen in the figures, the seal is located to rest on the conical section 30 of the coned bushing 14 and against the adjacent face of the slip assembly 18. In this manner, as the slip assembly expands radially outward as described above, the seal 22 expands radially outward in a commensurate fashion so as to provide a seal against the well casing in which the bridge plug assembly is provided.

In the initial position in the stacked assembly prior to setting, the molded assembly 16 at least partially circumscribes the stem 24 of the tee bushing 12 and the conical section of the coned bushing, particularly extending in part over the conical section 30 of the coned busing 14. The molded assembly 16 includes the slip assembly 18 over-molded with the elastomer 20. Ends 19 and 21 of the elastomer 20 extend over stepped ends of the segments of the slip assembly 18 to provide a locking engagement, which is described in greater detail below. The seal 22 may be configured as an annular sealing element that circumscribes the conical section 30 of the coned bushing 14. In the example of FIGS. 1 and 2, the seal 22 is configured as a separate element located adjacent to the molded assembly 16, although in an alternative embodiment the seal 22 may be an extension portion of the elastomer 20.

Figure 3:
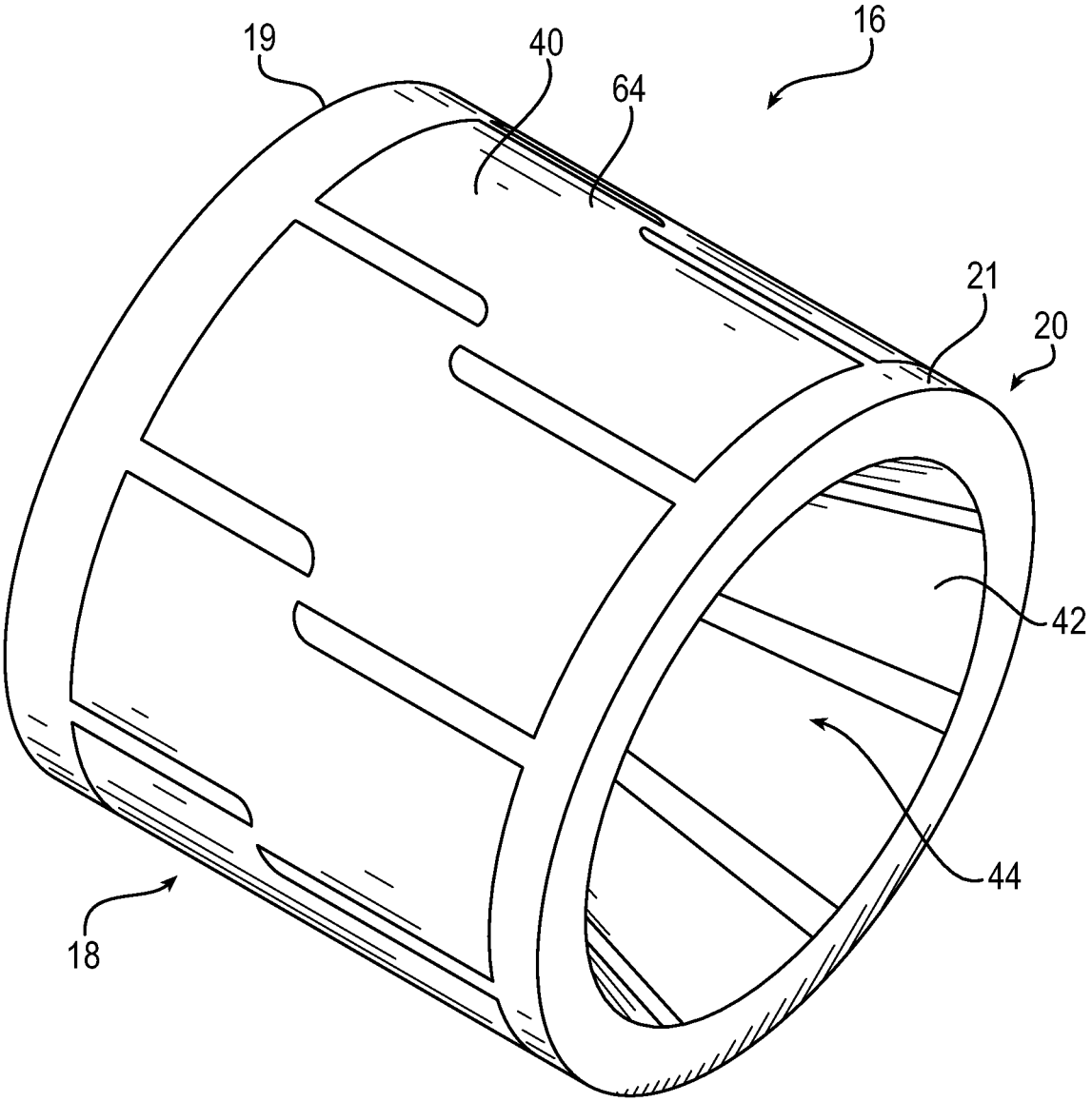
FIG. 3 is a drawing depicting an isometric view of a molded assembly component of the bridge plug assembly of FIGS. 1 and 2 in accordance with embodiments of the present invention.
Figure 4:
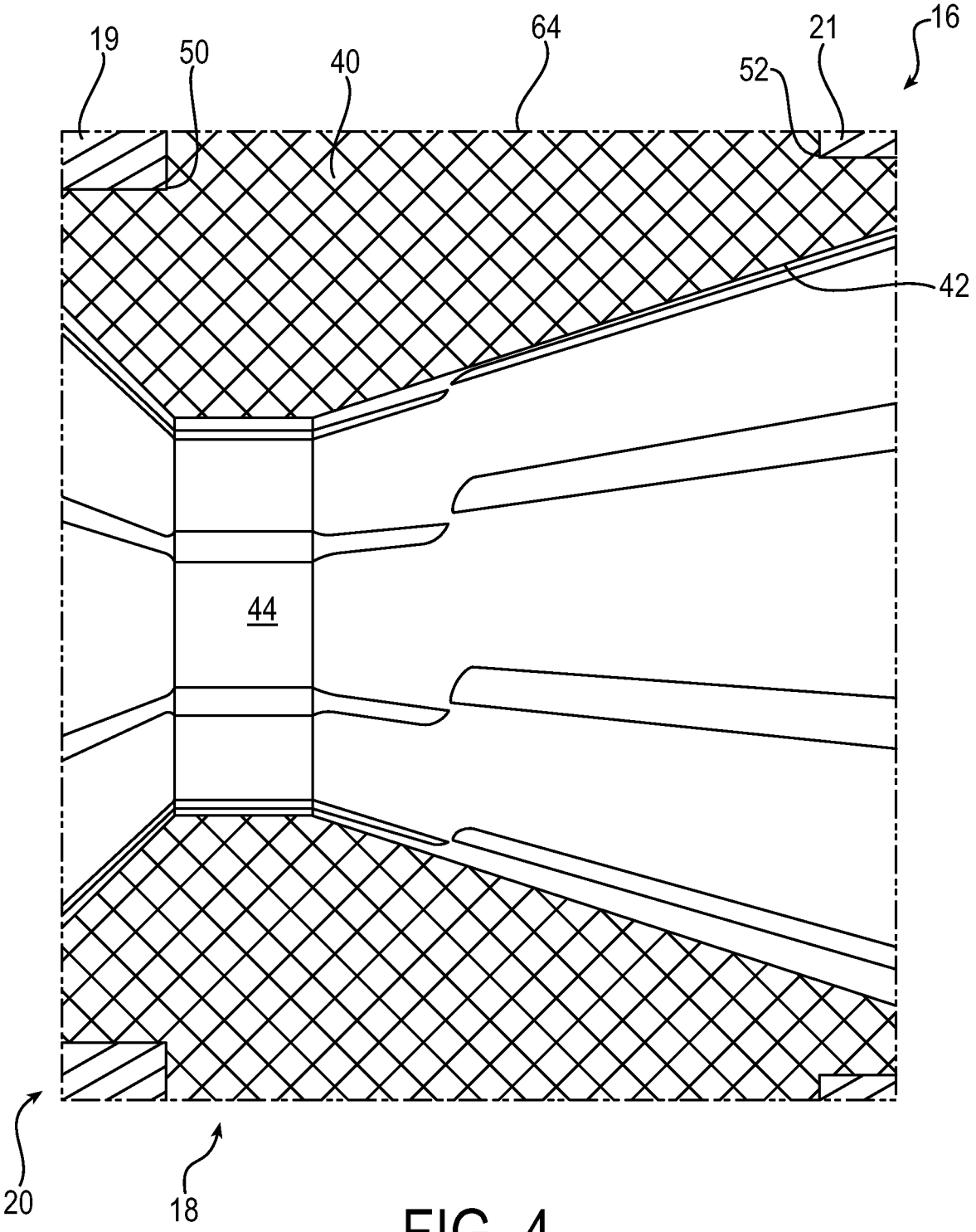
FIG. 4 is a drawing depicting a side cross-sectional view of the molded assembly component of FIG. 3.

FIG. 3 is a drawing depicting an isometric view of a molded assembly component 16 of the bridge plug assembly 10 of FIGS. 1 and 2 in isolation, in accordance with embodiments of the present invention. FIG. 4 is a drawing depicting a side cross-sectional view of the molded assembly component 16 of FIG. 3. Accordingly, like references numerals are used to refer to like components in FIGS. 1-4.

In exemplary embodiments, as referenced above the molded assembly component 16 includes a slip assembly 18 over-molded with an elastomer 20. Both the slip assembly and the over-molded elastomer likewise are made of dissolvable materials. The slip assembly 18 is a rigid element and thus may be made of a dissolvable metal alloy or PGA, and the elastomer 20 may be made of a dissolvable elastomeric material, which are described above. The slip assembly 18 may include a plurality of slip segments 40 configured as a polar array. When the slip segments are over-molded with the dissolving elastomer 20, the slip segments are locked in position in a manner that permits the slip segments to expand outward radially under pressure during the setting process. As seen particularly in FIG. 3, with such expansion the elastomer 20 expands commensurately and fills gaps that are present between slip segments due to the expansion of the slip assembly. In this manner, when the molded assembly expands moving from the initial position to the set position, the elastomer fills gaps formed between the slip segments.

The slip segments 40 are configured are to permit the elastomer 20 to lock onto the slip segments so as to create a continuous band of elastomer around the outer diameter of the entire slip assembly 18, as seen particularly in FIG. 3. Each slip segment has opposing stepped ends configured to receive opposing ends of the elastomer. The elastomer 20 includes the ends 19 and 21 that extend around the opposing stepped ends of the slip segments to enhance the locking of the elastomer 20 onto the slip assembly. The continuous band of elastomer acts as garter springs which allow the slip segments 40 to expand outward equidistantly when forced upon by the coned bushing 14.

The plurality of slip segments 40 each has a tapered surface 42 so that when they are molded in a polar array, the slip assembly creates a tapered bore 44 that faces toward the coned bushing 14 to provide a complementary taper relative to the conical section 30 of the coned bushing 14. In this manner, the configuration of the tapered bore 44 of the slip assembly 18 relative to the conical section 30 of the coned bushing 14 results in the coned bushing acting as a wedge that operates via a wedge action to expand the slip segments of the slip assembly radially outward during setting. Thus, the tapered surfaces of the slip segments interact with the conical section of the coned bushing via the wedge action as the molded assembly moves from the initial position to the set position. Such configuration further converts the mechanical load during setting and the load generated by fluid pressure during use into a radial load, by which the slip assembly grips the casing bore with increased tenacity as the fluid pressure rises.

Figure 5:
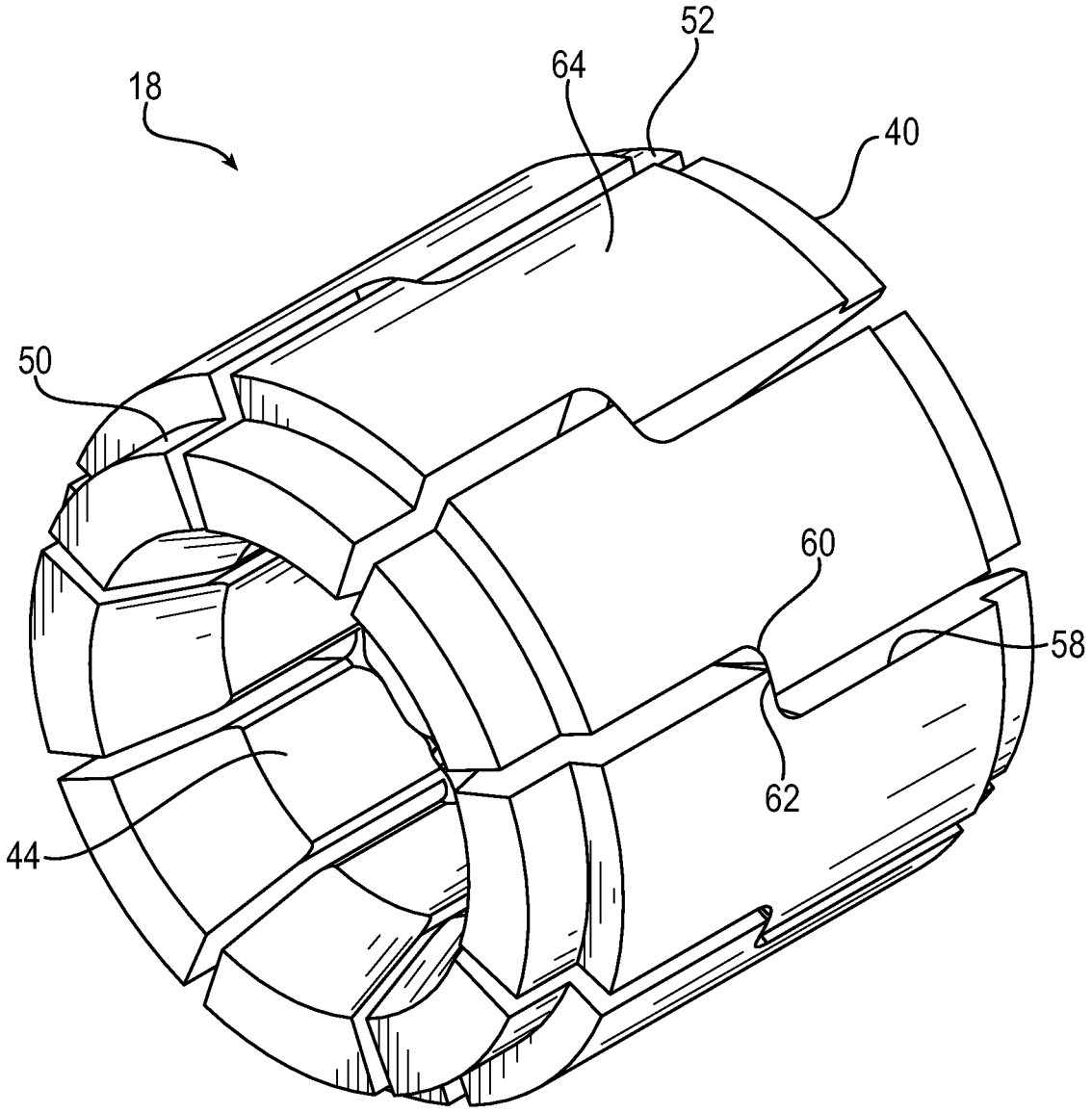
FIG. 5 is a drawing depicting an isometric view of an exemplary slip assembly in accordance with embodiments of the present invention for use in the bridge plug assembly.
Figure 6:
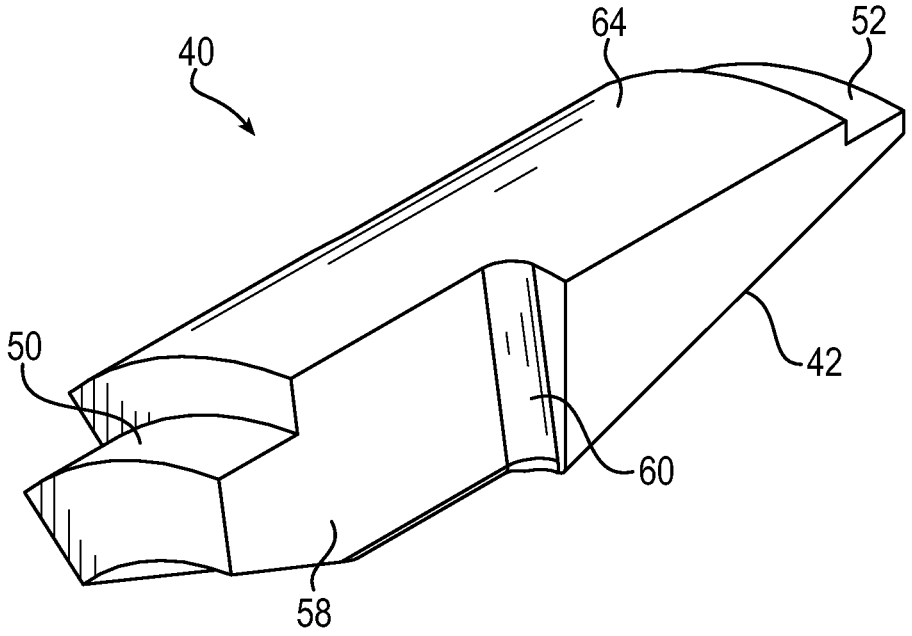
FIG. 6 is a drawing depicting an exemplary slip segment in isolation from the slip assembly of FIG. 5.

FIG. 5 is a drawing depicting an exemplary slip assembly 18 in accordance with embodiments of the present invention in isolation (i.e., with the over-molded elastomer removed). FIG. 6 is a drawing depicting an exemplary slip segment 40 in isolation from the slip assembly 18 of FIG. 5, and FIG. 7 is a drawing depicting the exemplary slip segment 40 of FIG. 6 from an edge view.

Figure 7:
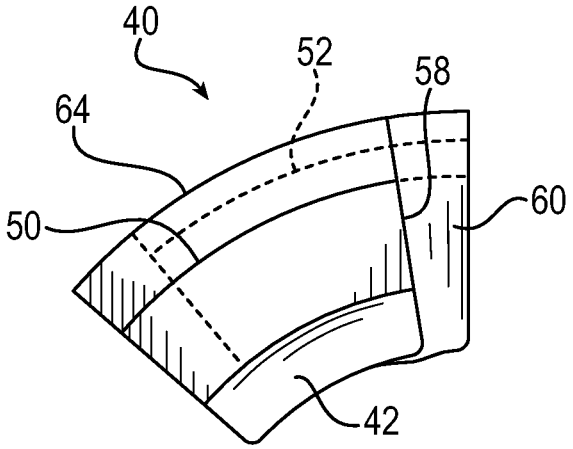
FIG. 7 is a drawing depicting the exemplary slip segment of FIG. 6 from an edge view.

With the views of FIGS. 5-7 with the elastomer removed, the features of the slip segments 40 are more readily visible. As referenced above, the slip segments each are configured to have stepped ends 50 and 52 that permit the elastomer 20 to lock onto the slip segments 40 on the outer diameter at elastomer ends 19 and 21. Referring to the previous figures, the stepped ends 50 and 52 receive the ends 19 and 21 of the elastomer 20. In exemplary embodiments as illustrated in the figures, the stepped ends 50 and 52 may be of different outer diameters. As referenced above, such configuration creates the continuous band of elastomer around the outer diameter of the slip assembly to result in the locked engagement. The tapered surfaces 42 run along opposite faces of the slip segments relative to the stepped diameters.

In addition, the slip segments 40 each may be configured with an angled face 58 to permit the plurality of slip segments to be assembled in a polar array with gaps of equal width between the slip segments. The angled faces 58 of the slip segments may have relief faces 60 cut into the angled faces about midway along the slip segment body length. These relief faces are cut into both angled faces of each slip segment and are mirror images of each other so that when the segments are arranged in the polar array, an area of overlap 62 is created by opposing relief faces 60 of adjacent slip segments. The areas of overlap 62 preferably should extend sufficiently to be maintained when the entire slip assembly is expanded to its maximum diameter. This overlapping configuration operates to support the over-molded elastomer 20 as it fills in the gaps between the slip segments 40 of the slip assembly 18, which prevents extrusion of the elastomer 20 by fluid pressure during use.

An outer surface 64 of each slip segment 30 is configured to grip an inner diameter of the well casing bore upon expansion of the slip assembly. The gripping operation may be accomplished by any suitable means known in the art. For example, the gripping operation may be accomplished by creating a surface with a high level of friction relative to the well casing bore, or by providing surface features (such as biting teeth) that can bite into the inner diameter of the well casing as a result of the slip assembly expansion.

The bridge plug assembly 10 may be assembled and set as follows. The components of the bridge plug assembly may be stacked together into a stacked configuration such as that of FIGS. 1 and 2. The bridge plug assembly is then connected to a setting tool (not shown) that holds the assembly together by attachment via the tee bushing through-hole 28 and end section 32 of the coned bushing 14. In particular, the tee bushing may be attached to the setting tool's draw rod which would extend into the through-hole 28, and remain attached until the setting process is complete. As mentioned previously, the tee bushing can be attached to the draw rod through a threaded feature, or through shear pins. The end section 32 of the coned bushing and the adjacent conical section 30 defining the bore 26 can be used to locate and constrain the coned bushing onto the setting tool.

In the setting process, the bridge plug assembly 10 is located at a desired position within a well casing, and then the setting tool is actuated. The setting tool then draws the tee bushing and coned bushing toward each other, joining the tee bushing and the coned bushing into an interference fit engagement. As the tee bushing and coned bushing are brought together, the tee bushing forces the molded assembly, including the slip assembly with the over-molded elastomer, to ride up the conical section 30 of the coned bushing and expand radially outward. The seal 22 also rides up the sloped taper of the conical section of the coned busing and expands radially outward commensurately. In this manner, with the conical section of the coned bushing configured as a wedge, when the stem of the tee bushing is forced into the conical section of the coned bushing during the setting process, the molded assembly and the seal move over the conical section from the initial position to the set position and expand radially outward by the wedge action of the conical section.

As the slip assembly and seal are expanded outward, such components expand until the slip assembly and seal make contact with the well casing inner diameter. At that point, further expansion under the action of the setting tool will force the coned bushing to load the slip segments against the casing bore and bite in, or otherwise grip the well casing, to anchor the bridge plug assembly in the desired position. The coned bushing will also compress the seal radially to effect a seal against the well casing bore and coned bushing. The coned bushing at such positioning is now restrained by the slip assembly and prevented from moving further toward the tee bushing. The tee bushing similarly is restrained by the adjacent face of the slip assembly and cannot move further toward the coned bushing.

Once such positioning is achieved with the slip assembly biting into or gripping the well casing bore, the bridge plug assembly cannot compress any further, and now the load being generated by the setting tool begins to climb. Eventually, the generated load is high enough to shear and release the setting tool's draw rod from the tee bushing, and the setting tool releases from the bridge plug assembly. The interference fit between the tee bushing and the coned bushing keeps all the components assembled together and retains a load between the coned bushing and the slip assembly to keep the bridge plug assembly anchored in place. After separation of the setting tool from the bridge plug assembly, the setting tool is pulled back up to the surface, and a dissolving ball sealer is sent down the casing and located on the inner diameter or seat surface 34 of the end section 32 of the coned bushing.

In this manner, an up hole portion of the well casing upstream of the bridge plug assembly is now isolated from a down hole portion of the well casing downstream from of the bridge plug assembly, and the well can now be pressurized to perform the fracturing treatment. The bridge plug assembly and ball sealer begin to dissolve immediately, albeit at a slow rate, and over time reduce in structure to allow flow to commence again through the well casing bore. The dissolution of the bridge plug assembly continues, and the bridge plug assembly eventually reduces to a pile of fine flakes and sludge, opening up the casing bore essentially to its original inner diameter. Accordingly, in the configuration of the present invention of the bridge plug assembly 10, the tee bushing and the coned bushing interact to expand the molded assembly to provide an enhanced operation as compared to conventional configurations. The bridge assembly further is fully dissolvable, and yet is smaller in size and uses less material thereby further improving over conventional configurations.

An aspect of the invention, therefore, is a bridge plug assembly. In exemplary embodiments, the bridge plug assembly includes a tee bushing including a base and a stem that extends from the base, a coned bushing having a conical section and defining a bore that is configured to receive the stem of the tee bushing, and an expandable molded assembly that is moveable over the conical section from an initial position to a set position, wherein in the initial position the molded assembly at least partially circumscribes the stem and the conical section. The conical section is configured as a wedge such that when the stem of the tee bushing is forced into the conical section of the coned bushing during a setting process, the molded assembly moves over the conical section from the initial position to the set position and expands radially outward by a wedge action of the conical section. Embodiments of the bridge plug assembly may include one or more of the following features, either individually or in combination.

In an exemplary embodiment of the bridge plug assembly, the molded assembly comprises a slip assembly over-molded with an elastomer.

In an exemplary embodiment of the bridge plug assembly, the slip assembly comprises a plurality of slip segments configured as a polar array, and when the molded assembly expands moving from the initial position to the set position, the elastomer fills gaps formed between the slip segments.

In an exemplary embodiment of the bridge plug assembly, each slip segment has opposing stepped ends configured to receive opposing ends of the elastomer.

In an exemplary embodiment of the bridge plug assembly, the stepped ends have different outer diameters.

In an exemplary embodiment of the bridge plug assembly, each slip segment has a tapered surface that interacts with the conical section of the coned bushing via the wedge action as the molded assembly moves from the initial position to the set position.

In an exemplary embodiment of the bridge plug assembly, each slip segment has an angled face including a relief face, and relief faces of adjacent slip segments are mirror images to provide areas of overlap of adjacent slip segments within the polar array.

In an exemplary embodiment of the bridge plug assembly, the bridge plug assembly further includes an annular seal that circumscribes the conical section of the coned bushing and is located adjacent to the molded assembly, wherein when the molded assembly moves from the initial position to the set position the seal expands radially outward by the wedge action of the conical section.

In an exemplary embodiment of the bridge plug assembly, the tee bushing defines a through-hole configured to receive a setting tool.

In an exemplary embodiment of the bridge plug assembly, the coned bushing has an end section with a sloped inner diameter that is configured as a seat surface for receiving a ball sealer.

In an exemplary embodiment of the bridge plug assembly, the tee bushing and the coned bushing are configured to join together in an interference fit.

In an exemplary embodiment of the bridge plug assembly, the tee bushing, coned bushing, and molded assembly are made from dissolvable materials.

In an exemplary embodiment of the bridge plug assembly, the seal is made of a dissolvable elastomeric material.

Another aspect of the invention is a setting process for a bridge plug assembly. In exemplary embodiments the setting process includes the steps of: providing a bridge plug assembly in accordance with any of the embodiments; connecting the bridge plug assembly to a setting tool and locating the bridge plug assembly at a desired position within a well casing; and actuating the setting tool to join the tee bushing and the coned bushing by forcing the stem of the tee bushing into the conical section of the coned bushing. The conical section is configured as a wedge such that when the stem of the tee bushing is forced into the conical section of the coned bushing by actuating the setting tool, the molded assembly moves over the conical section from the initial position to the set position and expands radially outward to the well casing by a wedge action of the conical section, thereby isolating an up hole portion of the well casing from a down hole portion of the well casing. The setting process my include one or more of the following features, either individually or in combination.

In an exemplary embodiment of the setting process, the molded assembly comprises a slip assembly including a plurality of slip segments configured as a polar array over-molded with an elastomer, and when the molded assembly expands moving from the initial position to the set position, the elastomer fills gaps formed between the slip segments.

In an exemplary embodiment of the setting process, in the set position, an outer surface of each of the slip segments grips an inner surface of the well casing.

In an exemplary embodiment of the setting process: the bridge plug assembly further comprises an annular seal that circumscribes the conical section of the coned bushing and is located adjacent to the molded assembly; and when the molded assembly moves from the initial position to the set position, the seal expands radially outward by the wedge action of the conical section to provide a seal against the well casing.

In an exemplary embodiment of the setting process, the coned bushing has an end section with a sloped inner diameter that is configured as a seat surface, the setting process further including locating a ball sealer in the seat surface.

In an exemplary embodiment of the setting process, the tee bushing, coned bushing, and molded assembly are made from dissolvable materials.

In an exemplary embodiment of the setting process, the seal is made of a dissolvable elastomeric material.

In an exemplary embodiment of the setting process, the ball sealer is made of a dissolvable material.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A bridge plug assembly comprising:

a tee bushing including a base and a stem that extends from the base to form a T-shaped configuration, wherein in use the base is positioned down-hole relative to the stem, and the stem has a through hole configured to accept a setting tool draw rod to attach the base of the tee bushing to the setting tool during a setting operation;

a coned bushing having a conical section and defining a bore that is positioned to receive the stem of the tee bushing, wherein in use the coned bushing is positioned up-hole relative to the base of the tee bushing; and an expandable molded assembly that is moveable over the conical section from an initial position to a set position, wherein in the initial position the molded assembly at least partially circumscribes the stem and the conical section and abuts against the base of the tee bushing;

the molded assembly including a slip assembly made of a rigid material and comprising a plurality of slip segments configured in a polar array, and an elastomer over-molded onto the slip assembly and that fills gaps between adjacent slip segments, wherein the elastomer maintains the slip segments in a locked position until moved over the conical section from the initial position to the set position;

wherein during a setting process the tee bushing and the coned bushing are drawn toward each other, whereby the base of the tee bushing forces the molded assembly from a down-hole side toward an up-hole side to ride up the conical section of the coned bushing;

wherein the conical section is configured as a wedge such that when the tee bushing and the coned bushing are drawn toward each other during the setting process, the stem of the tee bushing is forced into the conical section of the coned bushing, and as the molded assembly rides up the conical section from the initial position to the set position the slip assembly expands radially outward by a wedge action of the conical section with the slip segments moving apart from each other and the elastomer expanding to fill the gaps between adjacent slip segments; and wherein in the set position, the tee bushing and the coned bushing are joined together in a locked position with the stem of the tee bushing inserted in the bore defined by the coned bushing.

2. The bridge plug assembly of claim 1, wherein each of the plurality of slip segments has opposing stepped ends configured to receive opposing ends of the elastomer.

3. The bridge plug assembly of claim 2, wherein the stepped ends have different outer diameters.

4. The bridge plug assembly of claim 1, wherein each of the plurality of slip segments has a tapered surface that interacts with the conical section of the coned bushing via the wedge action as the molded assembly moves from the initial position to the set position.

5. The bridge plug assembly of claim 1, wherein each of the plurality of slip segments has an angled face including a relief face, and relief faces of adjacent slip segments are mirror images to provide areas of overlap of adjacent slip segments within the polar array.

6. The bridge plug assembly of claim 1, further comprising an annular seal that circumscribes the conical section of the coned bushing and is located adjacent to the molded assembly, wherein when the molded assembly moves from the initial position to the set position the annular seal expands radially outward by the wedge action of the conical section.

7. The bridge plug assembly of claim 6, wherein the annular seal is made of a dissolvable elastomeric material.

8. The bridge plug assembly of claim 1, wherein the coned bushing has an end section with a sloped inner diameter that is configured as a seat surface for receiving a ball sealer.

9. The bridge plug assembly of claim 1, wherein the locked position is provided by an interference fit.

10. The bridge plug assembly of claim 1, wherein the tee bushing, coned bushing, and molded assembly are made from dissolvable materials.

11. A setting process for a bridge plug assembly comprising the steps of:

providing a bridge plug assembly, the bridge plug assembly comprising:

a tee bushing including a base and a stem that extends from the base to form a T-shaped configuration;

a coned bushing having a conical section and defining a bore that is positioned to receive the stem of the tee bushing; and an expandable molded assembly that is moveable over the conical section from an initial position to a set position, wherein in the initial position the molded assembly at least partially circumscribes the stem and the conical section and abuts against the base of the tee bushing;

the molded assembly including a slip assembly made of a rigid material and comprising a plurality of slip segments configured in a polar array, and an elastomer over-molded onto the slip assembly and that fills gaps between adjacent slip segments, wherein the elastomer maintains the slip segments in a locked position until moved over the conical section from the initial position to the set position;

connecting the bridge plug assembly to a setting tool and locating the bridge plug assembly at a desired position within a well casing, wherein at the desired position the tee bushing base is positioned down-hole relative to the tee bushing stem and the coned bushing is positioned up-hole relative to the base of the tee bushing, and the stem has a through hole that accepts a setting tool draw rod that is attached to the base of the tee bushing; and actuating the setting tool to draw the tee bushing and the coned bushing toward each other by forcing the stem of the tee bushing from a down-hole side toward an up-hole side into the conical section of the coned bushing, whereby the base of the tee bushing forces the molded assembly to ride up the conical section of the coned bushing;

wherein the conical section is configured as a wedge such that when the tee bushing and the coned bushing are drawn toward each other during the setting process, the stem of the tee bushing is forced into the conical section of the coned bushing by actuating the setting tool, and as the molded assembly rides up the conical section from the initial position to the set position the slip assembly expands radially outward to the well casing by a wedge action of the conical section with the slip segments moving apart from each other and the elastomer expanding to fill the gaps between adjacent slip segments, thereby isolating an up hole portion of the well casing from a down hole portion of the well casing; and wherein in the set position, the tee bushing and the coned bushing are joined together in a locked position with the stem of the tee bushing inserted in the bore defined by the coned bushing.

12. The setting process of claim 11, wherein in the set position, an outer surface of each of the slip segments grips an inner surface of the well casing.

13. The setting process of claim 11, wherein:

the bridge plug assembly further comprises an annular seal that circumscribes the conical section of the coned bushing and is located adjacent to the molded assembly; and when the molded assembly moves from the initial position to the set position, the annular seal expands radially outward by the wedge action of the conical section to provide a seal against the well casing.

14. The setting process of claim 13, wherein the annular seal is made of a dissolvable elastomeric material.

15. The setting process of claim 11, wherein the coned bushing has an end section with a sloped inner diameter that is configured as a seat surface;

the setting process further comprising locating a ball sealer in the seat surface.

16. The setting process of claim 11, wherein the tee bushing, coned bushing, ball sealer, and the molded assembly are made from dissolvable materials.

* * * * *